United States Patent [19]

Lapeyre

[11] 4,112,424

[45] * Sep. 5, 1978

[54] ALPHANUMERIC DISPLAY SYSTEM

[75] Inventor: James M. Lapeyre, New Orleans, La.

[73] Assignee: Digicourse, Inc., New Orleans, La.

[ * ] Notice: The portion of the term of this patent subsequent to Nov. 9, 1993, has been disclaimed.

[21] Appl. No.: 666,456

[22] Filed: Mar. 12, 1976

[51] Int. Cl.[2] ..... G09F 9/32

[52] U.S. Cl. ..... 340/336; 340/324 M; 178/30

[58] Field of Search ..... 340/336, 324 M, 324 R, 340/166 EL; 178/30

[56] References Cited

U.S. PATENT DOCUMENTS

| | | | |
|---|---|---|---|
| 849,226 | 4/1907 | Garrett | 340/336 |
| 3,810,095 | 5/1974 | Bibl | 178/30 |
| 3,872,463 | 3/1975 | Lapeyre | 340/336 |

*Primary Examiner*—Marshall M. Curtis

*Attorney, Agent, or Firm*—Schiller & Pandiscio

[57] ABSTRACT

An alphanumeric display system including an array of preferably 14 or alternatively, 15 light-emitting elements capable, when selectively activated, of legibly forming all numerals, and various alphabet letters and/or mathematical and punctuation symbols. The arrays disclosed are characterized by the arrangement of the light-emitting elements in a closely nested relation to form horizontal rows and columns inclined to both the right and the left at 60° with respect to the horizontal. A solid state system for selectively energizing the light-emitting elements is disclosed.

15 Claims, 5 Drawing Figures

ALPHANUMERIC DISPLAY SYSTEM

Alphanumeric display systems of the type with which the present invention is concerned generally comprise an array or raster of light-emitting elements which can be individually activated or deactivated, or otherwise made visible selectively to form numerals, various letters and/or other symbols such as those used in mathematics, punctuation or the like. The elements may each be selectively activated to form a circle or circular dot, a square, a hexagon, or any other geometrical shape spot. The light-emitting elements as the term is used herein, are usually but not necessarily, of an electrically energizable type including, for example, conventional lamps such as incandescent and gaseous discharge, or solid state devices such as semiconductive crystals and light-emitting diodes. The latter devices are preferable in relatively small displays and/or in embodiments wherein energizing current is to be minimized. Display systems of this type are finding an increasing number of applications as readout devices on many different types of apparatus such as measuring instruments, recorders, computers and the like, that are electrically operated and where a clearly legible display with rapid response is desirable. It, therefore, is becoming increasingly more desirable to produce a display system of the type described which is relatively inexpensive to manufacture, made of minimum of parts, easy to read and easy to maintain.

One display system which is particularly promising is described in my U.S. Pat. No. 3,872,463 issued Mar. 18, 1975. The display comprises a minimum of 16 light-emitting elements which are energizable in selected combinations to form numerals, letters or other symbols. A major advantage of this display system is that it requires a minimum of 16 light-emitting elements and therefore can be inexpensively made and is easy to maintain. It has now been discovered however, that a display can be made with even fewer light-emitting elements decreasing the costs even to a greater extent. Such a system of reduced elements is particularly useful when it is employed to display all of the arabic numerals and various mathematical symbols.

It is therefore a general object of the present invention to provide a display system which overcomes the aforementioned problems of the prior art.

A further object of the present invention is to provide a display system of the type described comprising a novel array or matrix consisting of the fewest number of light-emitting elements, which is capable of forming all of the arabic numerals and various letters, mathematical and punctuation symbols.

Other objects and many of the attendant advantages of this invention are achieved by a novel array containing preferably 14, or alternatively, 15 closely nested, individual light-emitting elements specially arranged in five horizontal rows and four plural-element columns inclined so that characters formed on the display appear at a slant from the upper right of the display toward the lower left of the display as seen by the viewer at an approximate 60° angle with respect to the horizontal.

Other objects of the invention will in part be obvious and will in part appear hereinafter. The invention accordingly comprises the apparatus possessing the construction, combination of elements, and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings, wherein.

Figure 1:
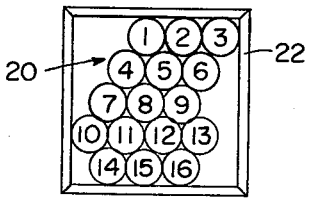
FIG. 1 PRIOR ART
FIG. 1 is a plan view of an embodiment of my prior art display.

Referring to FIG. 1 of the drawings, an array, designated 20, is shown as arranged in accordance with the 16 element display described in my U.S. Pat. No. 3,872,463. The array includes elements, each of which are illustrated as a circle or circular dot, supported by means such as frame 22 and arranged, as observed by the viewer, in five horizontal rows, each containing three or four elements. Specifically, the three upper rows and the bottom row of array 20 each contain three elements while the fourth or the next to the bottom row contains four elements. Thus, numbering the 16 elements, 1–16, from the top to the bottom of the array from left to right in each row, the first or top row comprises elements 1–3; the second row includes 4–6; the third row comprises elements 7–9; the fourth row includes elements 10–13; and the fifth or bottom row comprises elements 14–16. The elements 1–16 are arranged in closely nested relation similar to a mosaic composed of contiguous hexagons so as to form plural element columns which are inclined, as seen by the viewer at about 60° from the upper right to the lower left relative to the horizontal rows. The 60° inclination of the columns means that the arabic numerals, and various letters and symbols, particularly those with long components that are normally vertical such as numbers 1 and 0, will appear inclined to the right which is both pleasing in appearance and consistent with accepted practice such as cursive writing.

As observed by the viewer, the columns which are inclined from the upper right of the display to the lower left are arranged so that the first column or the column farthest to the left includes elements 1, 4, 7 and 10, the second column, or that column adjacent to, and to the right of the first column includes elements 2, 5, 8, 11 and 14, the third column or that column adjacent to and to the right of the second column includes elements 3, 6, 9, 12 and 15, while the fourth column, or that column farthest to the right includes elements 13 and 16. Although this 16 element display is economical, it has been found that at least one and preferably two of the light-emitting elements can be omitted, further economizing the manufacture of, as well as the maintenance of the types of displays described. The resulting displays are particularly useful where they are used to provide the various arabic numerals, some of the letters and other symbols.

Figure 2:
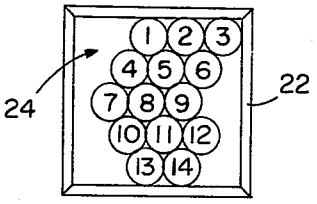
FIG. 2 is a plan view of the preferred embodiment of the present invention that shows diagrammatically a plurality of 14 light-emitting elements arranged in accordance with the invention illustrating how selective energization produces the arabic numerals 0–9.
Figure 2:
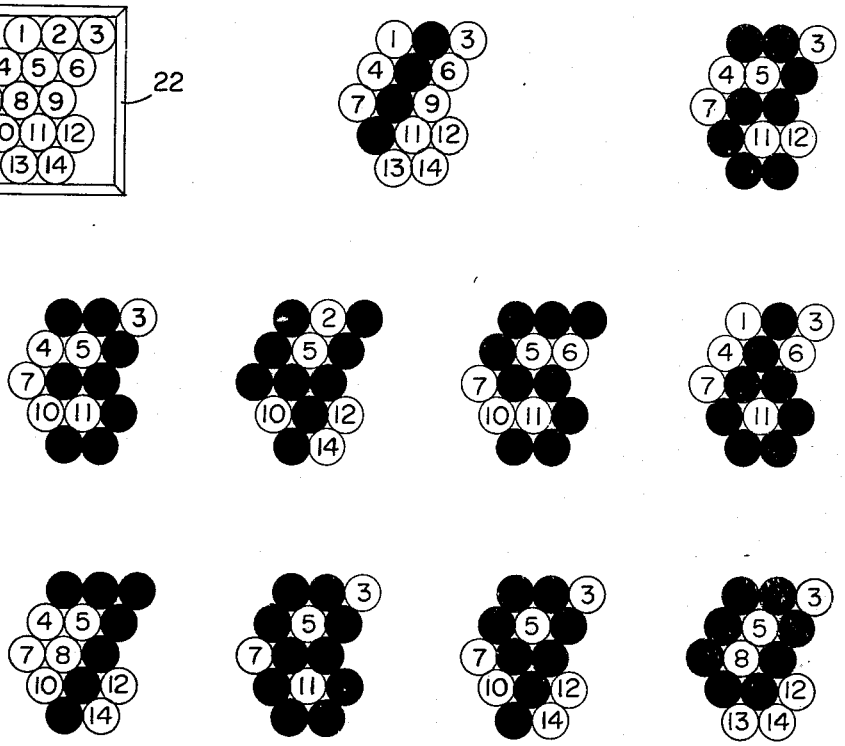

Thus, referring to FIG. 2, the preferred embodiment of the present invention is provided by removing both the elements 10 and 14 from the 16 element display of my prior art device described in FIG. 1 to form array 24 which is supported by frame 22. The array includes 14 light-emitting elements, which are arranged, as observed by the viewer, in five horizontal rows, each containing three or two elements. Specifically, the first or top row comprises elements 1–3; the second row comprises elements 4–6, the third row includes elements 7–9; the fourth row comprises elements 10–12; the fifth or bottom row, elements 13 and 14. The elements of this 14 dot display are arranged in a closely nested relationship as described with respect to the 16 element display of FIG. 1. The elements are thus arranged in plural element columns which are inclined as seen by the viewer at about a 60° angle with respect to the horizontal rows.

The columns are thereby inclined from the upper right of the display to the lower left so that the first or left column includes elements 1, 4, and 7; the second column or that column adjacent the first column includes elements 2, 5, 8 and 10; the third column to the right of the second column includes elements 3, 6, 9, 11 and 13, while the fourth column or that column furthest to the right includes elements 12 and 14.

The fourteen element display is capable of generating all of the arabic numerals, for example as illustrated in FIG. 2, plus many alphabet characters, mathematical and punctuation symbols (not shown). Thus, for example, the numeral "1" (which can be the letter "I") is formed by energizing elements 2, 5, 8 and 10 or elements 3, 6, 9, 11 and 13; numeral "2" by energizing elements numbered 1, 2, 6, 8, 9, 10, 13 and 14; the numeral "3" by energizing elements numbered 1, 2, 6, 8, 9, 12, 13 and 14; the numeral "5" by energizing elements 1, 2, 3, 4, 8, 9, 12, 13 and 14; and the numeral "0" is formed by energizing elements 1, 2, 4, 6, 7, 9, 10 and 11. Although not shown, various mathematical symbols can be provided. For example, a minus sign can be provided by activating elements 7, 8 and 9, a plus sign by activating element 5, 7, 8, 9 and 10, etc.

Although the 14-element display is preferred, it will be appreciated that a 15-element display can be provided without departing from the principles of the present invention.

Figure 3:
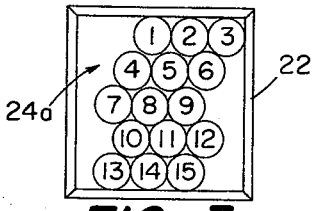
FIG. 3 is a plan view of a second embodiment of the present invention that shows diagramatically a plurality of 15 light-emitting elements arranged in an array.

Thus, referring to FIG. 3, a second embodiment of the present invention is provided by removing element 10 from the 16 element display of my prior art device of FIG. 1 to provide array **24*a*. The array thus includes 15 light-emitting elements, each of which are supported by frame 22 and arranged, as observed by the viewer, in five horizontal rows, each containing three or four elements. Specifically, all five, horizontal rows each contain three elements. Thus, the first or top row comprises elements 1–3; the second row, elements 4–6, the third row, elements 7–9, the fourth row 11–13; and the fifth or bottom row 14–15**.

As in the 14 and 16 dot displays, the elements are arranged in a closely nested relation similar to a mosaic composed of contiguous hexagons so as to form plural element columns which are inclined as seen by the viewer at about a 60° angle with respect to the horizontal rows from both the left to the right and right to left.

As observed by the viewer, the columns inclined from the upper right of the display to the lower left, are arranged so that the first column or the column farthest to the left includes elements 1, 4, 7, the second column, or that column adjacent to and to the right of the first column includes elements 2, 5, 8, 11 and 14; the third column, or that column adjacent to the right of the second column includes elements 3, 6, 9, 12 and 15; while the fourth column, or that column farthest to the right includes only element 13.

Figure 4:
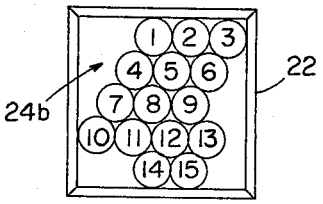
FIG. 4 is a plan view of a third embodiment of the present invention that shows diagramatically a plurality of 15 light-emitting elements arranged in an array.

Alternatively, a 15 element display **24*b* may be provided as shown in FIG. 4. Display 24*b* is provided by removing element 14 from the 16 element display of my prior art device of FIG. 1. The array includes 15 light emitting elements, arranged in five horizontal rows, each containing two, three or four elements. Specifically, the top three rows comprise three elements, the fourth row includes four elements, while the bottom row comprises two elements. The first or top row includes elements 1–3; the second row comprises elements 4–6; the third row includes elements 7–9; the fourth row comprises elements 10–13; while the fifth or bottom row includes elements 14 and 15**. The elements are closely nested together in the same relationship as the 14, 15 and 16 element displays previously described so as to form plural element columns which are inclined, as seen by the viewer, at about a 60° angle with respect to the horizontal rows from both the left to the right and the right to the left.

The columns which are inclined from the upper right of the display to the lower left are arranged so that the first column, or the column farthest to the left includes elements 1, 4, 7, and 10; the second column or that column adjacent to and to the right of the first column includes elements 2, 5, 8 and 11; the third column or that column adjacent to and to the right of the second column includes element 3, 6, 9, 12 and 14; while the fourth column or that column farthest to the right includes elements 13 and 15.

The 15 element displays of FIGS. 3 and 4 are adapted to display the arabic numerals and various letters and symbols as previously described and illustrated in FIG. 2, except that the additional light-emitting element 10 in FIG. 4 or 14 in FIG. 3 can be utilized to form the numbers, letter, or symbols.

Figure 5:
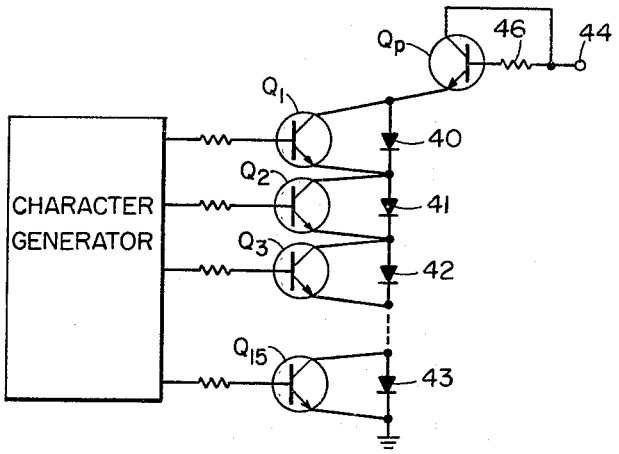
FIG. 5 is a schematic diagram of a solid state display system including means for energizing selected light-emitting elements.

The alphanumeric display arrays 24, **24*a* and 24*b* of light-emitting elements of the present invention are particularly adapted for use as a rapid response readout for electrically operated devices such as measuring instruments, recorders, computers or indicators. In application in which factors such as minimum size, low power requirements and rapid response are particularly desirable, the light-emitting elements may be solid state devices such as light-emitting diodes or semiconductor crystals. FIG. 5 shows an example of a solid state circuit for exciting either a 14 or 15 light-emitting diode array (only four of the 15 diodes being shown) and including switching means for controlling the energization of selected light emitting diodes. Light-emitting diodes are desirable as light sources because of their small size which enables the formation of arrays measuring a small fraction of an inch and because such diodes have a fast response and require only small operating currents in the order of milliamperes. In the system shown, the light-emitting diodes 40, 41, 42 and 43 are connected in series with one another and to the emitter of transistor $Q_p$ which serves as a constant current supply. The collector of the latter is connected to a terminal 44 at which a suitable voltage is applied, and its base is connected to the collector through resistor 46**. Switching of each diode as required for a particular symbol or character is achieved by connecting across each diode a transistor which when turned on, functions as a shunt for turning off the particular light-emitting diode.

The collector-emitter circuits of transistors designated $Q_1, Q_2, Q_3 \ldots Q_{15}$ are connected, respectively, across light-emitting diodes 40, 41, 42 . . . 43 and the bases of the transistors are coupled to character generators such as a group of current sources activated manually, or by computer, or in accordance with the output of an encoder or decoder which will provide the requisite character signals. The character generator provides signals that serve to turn on the transistors controlling those diodes that are not required for a specific character display. Thus, for example, when employing the array shown in FIG. 2, the numeral "4" is formed when light-emitting diodes corresponding to elements 1,3,4,6,7–9, 11 and 13 are activated and the transistors controlling the other elements are turned on thereby preventing energization of the corresponding remaining diodes.

While the circuitry shown is designed to produce a static display, it will be apparent that other circuitry may be employed, the design of which is known and within the skill of the art, for producing not only static displays, but strobed dynamic displays in which the emitters (LED's) are energized in rapid sequence. Dynamic strobing may have advantages in a number of applications, particularly in simplifying the interfacing of the display with a computer.

It will be apparent from the foregoing that the particular array of 14 or 15 nested, light-emitting elements provides for the formation of a maximum number of easily legible and aesthetically pleasing alphanumeric characters as well as a multiplicity of symbols employed in punctuation, mathematics, and the like while providing additional economy over the 16 element display of the prior art. These arrays have the advantage of versatility combined, if desired with small size, rapid response and low power requirements. A plurality of the arrays can be arranged in adjacent relation to provide for a visual display of multiple digit numbers, words, multiple word messages, mathematical and chemical equations, and the like, while the individual arrays can be of varying sizes as required and/or need be disposed only at locations where characters are required for a multi-character display. For example, where letters and numbers are employed together with numerical subscripts or superscripts as in chemical or mathematical formulae, both 14, 15 as well as the prior art 16 and 24 element arrays can be employed to advantage in the same group.

Since certain changes may be made in the above apparatus without departing from the scope of the invention herein involved, it is intended that all matter contained in the above description or shown in the accompanying drawing shall be interpreted as illustrative and not in a limiting sense.

What is claimed is:

1. An alphanumeric display comprising:

an array of at least 14 and not more than 15 light emitting elements; said array consisting of four horizontal rows each including at least three of said elements and one horizontal row of at least two elements, all of said elements of said array being arranged in a nested relation so as to form at least four plural element columns, each inclined with respect to said horizontal rows at an angle of about 60° from the upper right to the lower left as seen by the viewer and at least five plural element columns, each inclined with respect to said horizontal rows at an angle of about 60° from the upper left to the lower right as seen by the viewer.

2. A display in accordance with claim 1, wherein the two-element row is the bottom row.

3. A display in accordance with claim 1, wherein said array consists of 14 of said elements.

4. A display in accordance with claim 3, wherein said rows are arranged so that said plural element columns inclined from the upper right to the lower left include from left to right, a three element column, a four element column, a five element column, and a two element column.

5. A display in accordance with claim 4, wherein the top four horizontal rows include three of said elements and said bottom row includes two of said elements.

6. A display in accordance with claim 1, wherein said array consists of 15 of said elements.

7. A display in accordance with claim 6 wherein said rows are arranged so that said plural element columns inclined from the upper right to the lower left include from left to right, a three element column, a five element column, a five element column and a two element column.

8. A display in accordance with claim 6 wherein said rows are arranged so that said plural element columns inclined from the upper right to the lower left include from left to right, a four element column, a four element column, a five element column and a two element column.

9. A display in accordance with claim 6, wherein each of said rows includes three of said elements.

10. A display in accordance with claim 6 wherein said rows each includes, from top to bottom, three elements, three elements, three elements, four elements and two elements.

11. A display in accordance with claim 1, wherein each of said elements is substantially circular.

12. A display in accordance with claim 1, wherein each of said elements is electrically energizable.

13. A display in accordance with claim 12 further including means for selectively energizing each of said elements.

14. In an alphanumeric display of the type having an array of light-emitting elements, wherein the improvement comprises an array of at least 14 and not more than 15 closely nested light-emitting elements, said elements being arranged in five horizontal rows of two, three or four elements and at least four plural-element columns inclined with respect to said horizontal rows at an angle of about 60° from the upper right to the lower left as seen by the viewer including in order from left to right, at least one three element column, a four element column, a five element column and a two element column.

15. A display in accordance with claim 14, wherein said array consists of 14 of said elements and the top four of said five horizontal rows consists of three of said elements and said bottom horizontal row consists of two of said elements.

* * * * *